United States Patent [19]

Goldowsky

[11] Patent Number: 4,957,072

[45] Date of Patent: Sep. 18, 1990

[54] BALANCED RADIAL ENGINE

[76] Inventor: Michael P. Goldowsky, 7 Greenwood La., Valhalla, N.Y. 10595

[21] Appl. No.: 334,600

[22] Filed: May 15, 1989

Related U.S. Application Data

[63] Continuation-in-part of Ser. No. 276,943, Nov. 28, 1988.

[51] Int. Cl.[5] ..... F02B 75/22

[52] U.S. Cl. ..... 123/55 A; 123/185 D; 123/437; 123/580; 123/DIG. 1; 123/DIG. 3; 261/232; 261/67

[58] Field of Search ..... 123/DIG. 8, DIG. 1, 123/DIG. 3, DIG. 6, 55 R, 55 A, 179 G, 185 D, 437, 579, 580, 452, 462; 261/232, 67, DIG. 2

[56] References Cited

U.S. PATENT DOCUMENTS

| | | | |
|---|---|---|---|
| 735,035 | 7/1903 | Jones | 123/55 A |
| 2,044,113 | 6/1936 | Woolson | 123/55 A |
| 2,419,305 | 4/1947 | Woolson et al. | 123/55 A |
| 2,491,630 | 12/1949 | Voorhies | 123/DIG. 8 |
| 2,618,253 | 11/1952 | Angle | 123/DIG. 6 |
| 2,671,983 | 3/1954 | Roehrl | 123/DIG. 3 |
| 3,022,053 | 2/1962 | Hoyt | 123/579 |
| 3,308,797 | 3/1967 | Buyatti | 123/55 A |
| 3,734,072 | 5/1973 | Yamda | 123/DIG. 3 |

FOREIGN PATENT DOCUMENTS

| | | | |
|---|---|---|---|
| 675425 | 2/1930 | France | 123/55 A |
| 392282 | 5/1933 | United Kingdom | 123/55 A |
| 1149988 | 4/1969 | United Kingdom | 123/DIG. 8 |

*Primary Examiner*—David A. Okonsky

[57] ABSTRACT

A low cost multi cylinder radial aircraft engine is composed of an even number of individually functional, single cylinder slider crank model engines. They are mounted to a plate to form equally spaced radially oriented cylinders. In the preferred embodiment, use of standard, low cost, & mass produced two cycles engines are used. This in conjunction with a novel exhaust muffler and throttle mechanism results in a low cost radial engine. The individual engine shafts surround and are parallel to a central output shaft. Pinion gears on each shaft transfer power to a larger sun gear on the output shaft. This gearing synchronizes opposed pistons to reach top dead center at the same time resulting in vibration free piston motion and perfect balance of the entire engine. Said gearing also provides speed reduction for use of large diameter scale propellers. A rear mounted throttle mechanism controls individual carburetor throttles. Each cylinder radially exhausts into a donut shaped exhaust manifold that also serves as a muffler at the front of the engine. It very effectively lowers cylinder exhaust noise by using opposed flow impingement. The muffler also utilizes turbulent gas cooling to greatly reduce exhaust gas temperature and energy. This results in very low noise like its 4 cycle competitor.

16 Claims, 3 Drawing Sheets

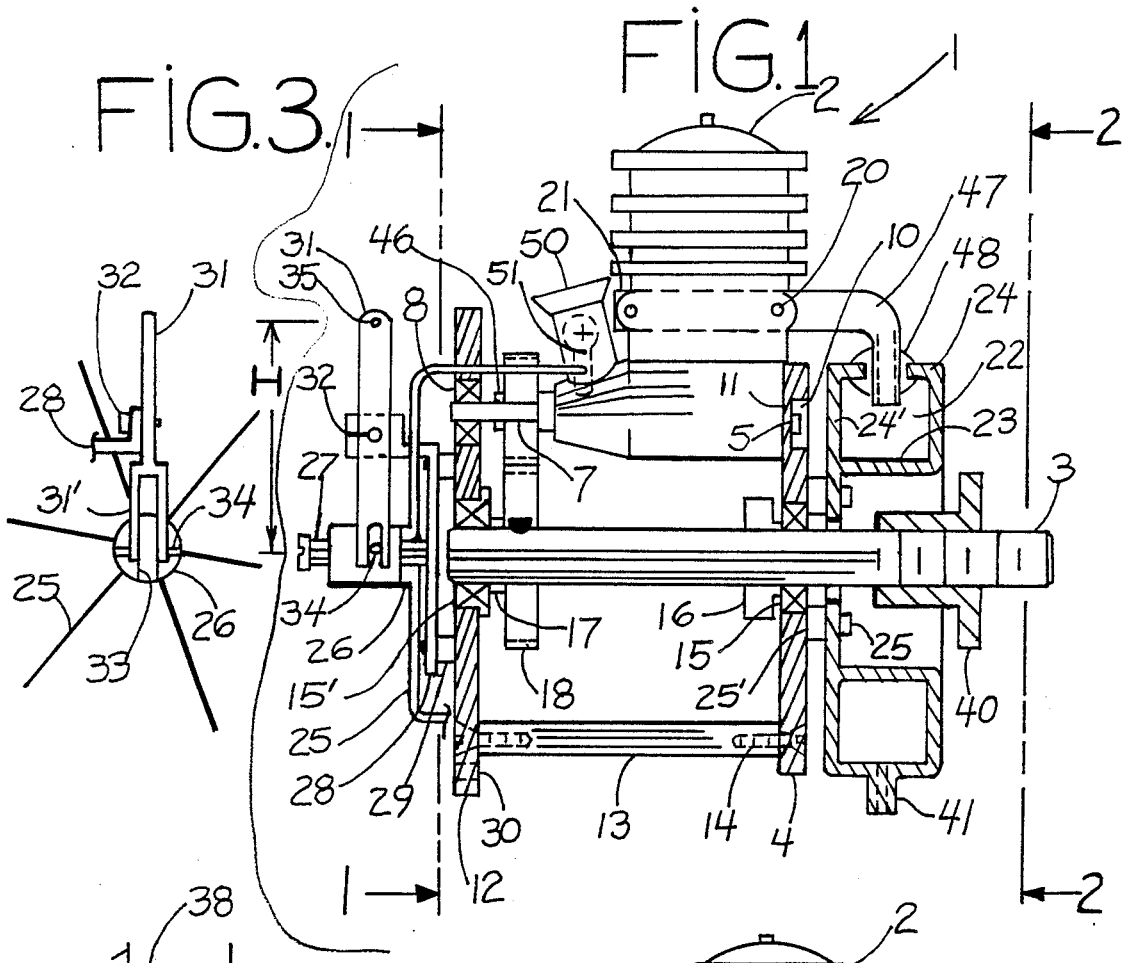
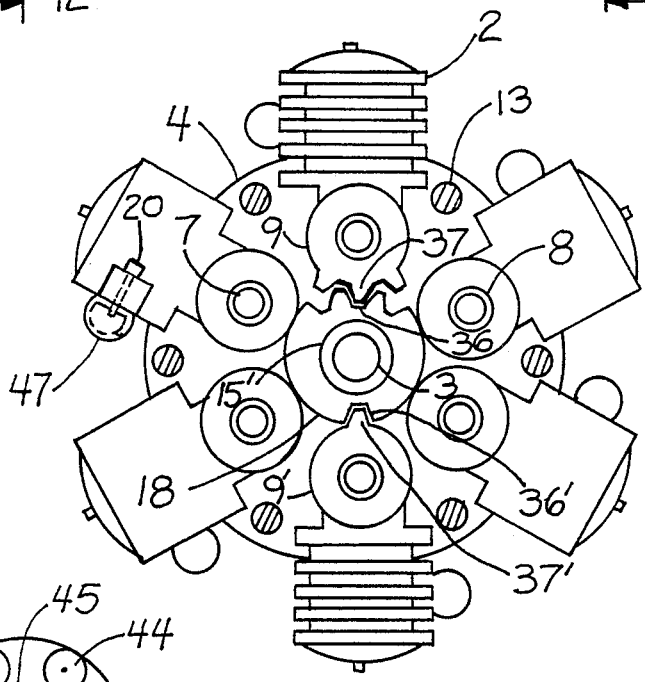
FIG. 2.
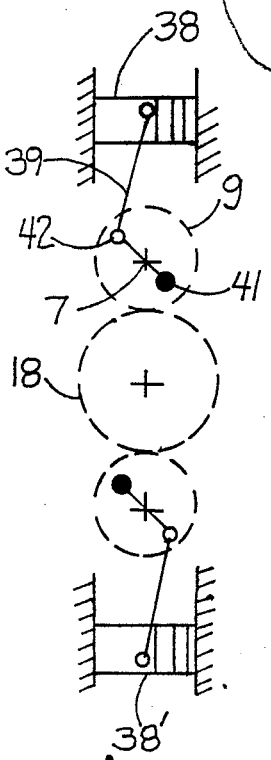
FIG. 4.
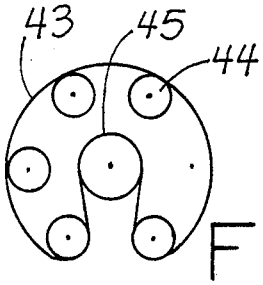
FIG. 5.

BALANCED RADIAL ENGINE

This application is a continuation-in-part of my pending application Ser. No. 276,943 filed Nov. 28, 1988.

BACKGROUND OF THE INVENTION

This invention relates to improvements in multi-cylinder radial aircraft engines and more specifically to model aircraft radial engines. Multi-cylinder radial engines are used by scale-model and radio control enthusiasts to provide the utmost in realism and appearance. Because present day radial engines are extremely expensive, most scale modelers use single cylinder engines that are massed produced and low in cost. They then add plastic or non-functional cylinders to simulate the appearance of the radial engine. The single cylinder two cycle engine is overwhelmingly the most common engine used to power engines today, because of its low cost. Consequently, if the price of the radial engine could be substantially reduced, more would be in use.

Present radial model engines are of the four cycle variety. They use the same drive mechanism for producing rotation of the output shaft as their counterpart full size engines. The pistons are equally spaced circumferentially in radial cylinders located on a common crankcase. The piston connecting rods pivot on a common crank plate except for one which is rigidly connected. This rigid joint keeps the plate orientation fixed relative to the crankcase. The center of the crank plate has a bearing that rotates on the crank of the output shaft. Rotation of the output shaft results in nutation of the plate and sequential sinusiodal linear motion of the pistons.

The fact that radial engines have the above mechanism, as well as several cylinders and pistons, obviously increases their cost compared to the same displacement one cylinder engine. Nearly all model radial engines are the four cycle type. They incorporate two valves per cylinder, two push rods per cylinder, and associated cams. All of these parts add to the complexity of the engine and contribute to its high cost. Nevertheless, the four cycle radial engine is used because of its lower noise and reduced shaft speed compared to the two cycle type. Four cycle types do not require a sophisticated muffler as do two cycle counterparts. On existing four cycle radials, each cylinder is exhausted directly to the atmosphere in order to eliminate an expensive muffler system. Four cycle radials are also dominant at present because they operate at higher torque levels and lower speed than would a similar two cycle radial. They can swing a larger propeller to more effectively clear the large diameter of the radial engine.

The high cost of manufacturing a limited number of radial engines is an important problem overcome by the instant invention. The number of modelers who want to purchase scale radial engines, even at a lower price, is not extremely large. So mass production of these engines for cost reduction does not occur. For example, the primary four cycle radial engine manufacturer in the U.S. only produces about 300 five cylinder radial engines per year at a selling price of $1200. In comparison, the mass produced two cycle single cylinder engine of equal power costs about $120. It uses the simple slider crank mechanism with a single rotary valve usually made part of the crankshaft. The piston motion covers and uncovers the intake and exhaust cylinder ports so separate valves are not needed. Parts count is low and so is cost.

A common disadvantage of present art radial engines is that they cannot be perfectly balanced even though the pistons are located in a common plane. A counterweight attempts to offset the weight of the pistons, connecting rods and nutating motion of the crankplate. These forces cannot be compensated for with the addition of weights alone on the crankshaft. A double row radial engine is needed to effect balance but this is not practical for model use. Even a single cylinder slider crank engine cannot be balanced. The crankshaft counterweight can only offset the crank shaking force but not that of the piston.

Vibration of model aircraft engines has long plagued radio control modelers. The airframe of aircraft must be made stronger and heavier to sustain this punishment. Vibration also results in lower reliability of the onboard radio and electronics. Special mounting precautions for receivers, batteries, and servos have to be taken using rubber isolation mounts or packaging them in foam rubber. Consequently, having a perfectly inertia force balanced engine of this invention would be a major advantage.

A third disadvantage of existing multi-cylinder radial engines is their fixed ratio in output speed. The output shaft is directly coupled to the piston motion or speed of the crank. Therefore, the propeller size that can be used with a given engine is fixed within narrow limits.

A fourth disadvantage in present art radial engines results when using the four cycle engine. It produces lower specific power, that is horse power per cubic inch of displacement, compared to the two cycle engine. This has always been a major disadvantage of single cylinder four cycle engines. But recent community concerns over noise are making the four cycle engine more popular. A very quiet 2 cycle radial engine would address this concern.

Having now discussed the main disadvantages of present art radial engines, mainly: high-cost, vibration, inflexible output speed, and lower specific power for the four cycle type; the following objects of the instant invention can be stated. A primary object of the present invention is to configure a radial multi-cylinder engine by grouping together mass produced single cylinder engines and in particular two cycle engines as building blocks. This will permit the use of massed produced individual engines of low cost. Another object of the instant invention is to create a completely forced balanced engine that is free of vibration. This is accomplished by eliminating the prior art crankplate and using geared outputs of the individual engines, each incorporating its own slider crank mechanism. The present art crankplate creates sequential piston motion and does not allow in phase motion of opposed pistons that is required for balancing by the instant invention. Another object of the invention is to increase engine output torque to at least that of the four cycle radial engine by employing gear reduced two cycle engines as components. And yet another object of the invention is to produce different models by changing the gear ratio. This will allow adaptation of the same engine for use with various size propellers. And another object of the present invention is to integrate in a compact manner an exhaust manifold and muffler to produce a realistic sound at a low noise level for muffling two cycle engines. Another object of the invention is to provide a single throttle means that controls the individual carburetors of each building block engine. Yet another object of the invention is to create a realistic, aesthetic looking engine where the front view of the cylinders is unobstructed by the gearing means, throttle means, or carburetors, to mimic the appearance of full size engines. And yet another object of this instant invention is to create an engine of high specific power by utilizing two cycle high speed high power engines as building blocks that are readily available and mass-produced inexpensively. This does not preclude the use of four cycle engine building blocks. A final object of the instant invention is to provide counter-clockwise propeller rotation, as this is standard.

These and other objects of the present invention are accomplished in accordance with a preferred embodiment of the present invention. For illustrative purposes only, 6 model aircraft engines are equally spaced and radially oriented by mounting them to a common circular plate using their existing rear crank case cover screws. This eliminates the need for a separate mount while allowing each engine to be rearward facing. A second plate is rigidly mounted to the first using spacers and creates the engine structural frame. Holes in the rear plate also serve to mount the radial engine to a fire wall. The end plates centrally house ball bearings that support the output propeller shaft.

The shaft of each building block engine has a pinion gear mounted there on. These gears mesh with a central or sun gear and transmit their power to the output shaft. Outboard ball bearings are positioned in the second plate to support the end of each engine's shaft. This is advantageous so that low cost engines can be used that do not employ crank shaft ball bearings and are not designed for supporting over hung loads. The outboard ball bearings also locate the shaft at an accurate center distance for proper gear mesh, eliminating the need for adjustments.

By using an even number of radial engines located in a single plane, pairs of pistons result that are diametrally opposite or 180 degrees apart. They are timed to fire at the same time, unlike existing radial engines that must sequentially fire. Any pair of opposed pistons moves radially outward or inward in synchronism, thereby inertia balancing one another. Since the crank mechanisms are balanced with counterweights and are identical, perfect balance of paired engines results. Consequently, the radial engine as a whole is completely force balanced.

The output gear ratio can be readily changed even though the center distance is fixed for a given engine. Using smaller diameter pinion gears and a larger output gear will reduce the output speed to accomodate a larger propeller. Thus different models are readily produced of the same basic engine to meet the needs of the customer.

The use of rearward facing individual engines positions the gear train and carburetor to the back of the engine where they may be readily hidden, if desired, inside the cowel of the model aircraft. When viewed from the front, unobstructed radial cylinders are seen. The normal counter clockwise rotation of each building block engine is now clockwise when viewed from the front of the radial engine. The use of gearing reverses this and again results in counter clockwise rotation of the output shaft. Counter clockwise propeller rotation is highly desireable as this is the normal or accepted direction for propeller rotation. Even though the use of gearing is preferred, a belt drive is not precluded.

Each building block engine utilizes its own carburetor for mixture control. These carburetors are mass produced and are supplied with each engine. A simple linear motion linkage, synchronizes and simultaneously operates the individual carburetor air intakes. The linkage is located at the rear of the engine. It consists of a spider to hold 6 radial control wires that attach to the carburetors. The spider slides on a pin located on the centerline of the engine to actuate the carburetors. This symmetry results in equal activation. In an alternate embodiment, a single carburetor can be used in conjunction with an intake manifold that supplies each engine's inlet, but this does not perform as well because of its excessive dead volume.

A round doughnut shaped muffler is located at the front of the engine. It is screwed to the front plate using thermally insulated spacers. Each radial cylinder exhausts into an exhaust tube that is attached to the cylinder exhaust port using existing holes. The tube diverts the cylinder exhaust into the muffler which also serves as an exhaust manifold. Using equally spaced radially entering exhaust tubes has been found to result in very low noise levels. The muffler is donut shaped to allow passage of the propeller shaft through its center. The exhaust exits thru preferably a single port directing fumes and oil away from the engine. When viewed from the front, the muffler simulates the crank case of real aircraft engines. The muffler is synergistically used for noise abatement, as an exhaust manifold, and as a visually appearing crank case. Being located at the front, direct air flow from the proppeller keeps it cool and allows effective cooling of the muffler gasses.

BRIEF DESCRIPTION OF THE DRAWINGS

A brief description of the drawings is now made with reference to the following figures.

FIG. 1 is a partially sectioned side view of the radial engine showing one of six rear facing two cycle engines mounted between the front and rear plates. The radial engine output shaft ball bearings and the engine shaft support ball bearing are clearly shown as well as the gear train in side view. The muffler is in section on the right while the throttle linkage is on the left.

FIG. 2 is a rear view of FIG. 1 with the left plate removed, essentially along direction 1—1. It shows the output shaft of each engine in end view with their respective gears, as well as the output sun gear and propeller shaft. FIG. 2 also shows the preferred construction and location of the engine exhaust tubes, and radial orientation of the cylinders. Cooling fins on the cylinder heads are shown on only two opposed cylinders for clarity.

FIG. 3 is a partial end view of FIG. 1 showing the throttle linkage mechanism and its support means.

FIG. 4 is a schematic of the radial engine mechanism. It is used to explain in detail why the use of two cycle engines employing the slider crank mechanism results in no unbalanced inertia forces or moments in the instant invention.

Finally, FIG. 5 is a schematic depicting an alternative belt drive in place of gearing. It is a rear view taken essentially along direction 1—1.

DETAILED DESCRIPTION OF THE DRAWINGS

Figure 6:
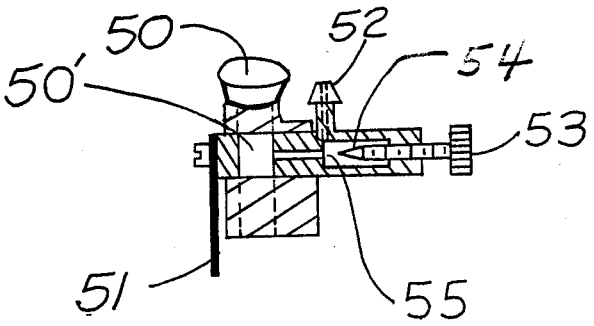

Referring to the drawings, FIG. 1 shows the essential features of a six cylinder radial engine generally designated 1. It is composed of six individual two cycle engines, with radial cylinders, a typical engine designated 2. They are equally spaced (as shown in FIG. 2) about the output or propeller shaft 3. These engines may be screwed into the first support plate 4 using crank case cover screws 5. The crank case covers 6 must be tightly screwed to each engine to make a good seal. Engines 2 have their output shafts 7 supported by ball bearings 8 to insure accurate radial and circumferential location of attached gears 9. These gears may be threaded on the engine shaft and locked using thread bonding compound and a lock nut 46.

The addition of an outboard support bearing 8 over constrains the motor shaft because the crank case cover 6 is not generally manufactured sufficiently square to the shaft axis. Tightening of screws 5 would cause very high loads on bearing 8 and the engines internal crank case bearing if some compliance were not provided. Counterbores 10 are machined in plate 4 at each mounting screw 5 location to create a thin diaphragm 11 that can flex axially and provide the required axial compliance. For example, a 15 mil thick diaphragm of 0.50 inch diameter in 6061 aluminum, creates several pounds of force at the ball bearing for 0.003 inch out of squareness of cover 6. This is an acceptable load. The use of novel counter bored pockets to create diaphragms eliminates the need for a special mount or costly machining of item 6. The diaphragms have the desired property that they are very stiff radially yet easily deflect axially. Radial stiffness is needed to keep the gears in accurate alignment.

Still referring to FIG. 1, the rear side plate 12 is rigidly attached to plate 4 using preferably 6 equally spaced aluminum spacers 13 with flat head screws 14. Use of flat head screws eliminates the potential of plate slippage. Propeller output shaft ball bearings 15 and 15' are located in plates 4 & 12 respectively. Shoulders on the bearings allow them to transfer axial loads to these plates. A collar 16 fastened to shaft 3 presses on the inner bearing race of bearing 15 to absorb the propeller thrust which is directed to the right. Rear bearing 15' absorbs leftwardly directed axial loads placed on the shaft as when an electric starter motor is pressed against the propeller hub. Inner race washer 17 is located between the bearing and output gear 18 to transfer this load or the output gear may be machined with a shoulder to eliminate the washer. Output gear 18 is secured to the propeller shaft using a key 19 or other means. The output gear is preferably made of a high strength wear resistant plastic such as polyimide-amide or carbon fiber filled nylon that is impregnated with molybdenum disulfide lubricant. Such a gear mating with low cost hard anodized aluminum gears 9, has been found to run quietly and requires minimal lubrication. Glass filled plastic, although of high strength, prematurely wears the gears 9 and are not satisfactory. To reduce the material cost of the output gear, the volume of plastic may be minimized by using a large diameter aluminum hub to which an outer ring of the plastic is bonded. This design also provides a high strength hub to key to the output shaft. The output shaft delivers power to the attached hub 40, to which the propeller is mounted using a shaft nut.

Hollow exhaust tubes 47 are fastened to the exhaust port of each engine 2 as shown in FIG. 2, using a flat on the tube and screws 20. The tube may be made from aluminum tubing with a bonded end plug 21. The tube is bent into a 90 elbow to preferably radially discharge exhaust gasses into the exhaust manifold 22 which is shown in section. A silicone rubber high temperature grommet 48 seals the tube in the manifold. The grommet also serves to reduce noise by isolating the engine from the muffler. By choosing the internal volume of the manifold at least twice as large as the radial engine displacement, some of the engine noise is attenuated by converting the pulsating exhaust wave to D.C. This is conventional expansion muffler smoothing due to volumetric capacitance C. Baffeling also reduces noise. The geometry shown is self baffeling as the gas impinges on the inner rim 23. Thus, inlet gas has no direct line of sight to the muffler exit 41, shown in FIG. 1. The radial impingement of hot gasses on surface 23 also sets up a swirling motion of gases along the walls 24 and 24'. The large surface area of these walls in conjunction with propeller air flow, effectively cools the gas while it is still in the muffler, and this reduces its velocity and energy content. The kinetic and thermal energy of the cooled gasses that will exit the exhaust port 41 is greatly reduced, resulting in additionally lowered noise levels. A fourth advantage in the symmetrical entrance of gases has been found to be cancellation of noise by symmetry. The flow from each exhaust tube impinging on surface 23 also splits circumferentially. Half goes clockwise while the other half flows counter clockwise. This gas meets oppositely directed gasses from adjacent tubes and is decelerated by this impingement. Substantial kinetic energy is lost without the need of mechanical baffels that cause pressure drops.

Thus, the exhaust manifold, which groups together the individual cylinder exhausts, also serves as an efficient muffler. Power loss is an important concern to modelers and this design has very low losses. The flow cross sectional area is large and unconstricted everywhere. The exhaust port diameter can also be large creating little pressure drop. Normal expansion type mufflers require a restricted exhaust port to operate quietly because they rely on the RC time constant of the muffler volume C and exhaust restriction R for smoothing. The exhaust port resistance R must be sufficiently large to be effective as these mufflers do not benefit from the energy absorbing techniques inherent in the instant design.

The muffler may be made from a thin walled aluminum investment casting or is built up using thin aluminum sheet bonded together with high temperature epoxy. The left wall 24' is extended inward to create a mounting flange as shown in FIG. 1. Screws 25 secure the muffler to the side plate. Phenolic insulator spacers 25', minimize heat conduction to the plate to keep the engine crank cases 2 and ball bearing 15 cool. The spacers also create an insulating air gap all along wall 24'.

When looking at the front of the radial engine along view 2—2 one sees an unobstructed view of all 6 cylinders. The engine mounting screws 5, are hidden behind the muffler and are not seen. The muffler diameter is chosen to do this. Muffler tubes 47 have internal inserts with threads so that screws 20 do not protrude for better esthetics.

Referring now to the throttle mechanism shown in FIG. 1, links made of six pieces of steel wire 25 are equally spaced and bonded into radial holes in the slider block 26. Block 26 slides on a standoff 27 that is fastened to bracket 28. This bracket is screwed down to the rear engine plate 12 using screws & spacers generally designated 29. The steel wires 25 are attached to the rotatable throttle links 51 of the carburetors 50. Back and forth sliding of block 26 results in equal rotary motion of all 6 links. Clearance holes are provided in the rear plate for the wires to pass through. By positioning the block on the centerline of the engine all six wires are of equal length and the forces on the block are balanced. It has no tendency to cock or bind.

In most model aircraft, the fuel tank is located directly behind the engine firewall on the engine's center line. To make this space available it is desireable to activate the slider block at a radial distance H from the engine centerline. This allows a throttle push rod to be placed outboard of the fuel tank. To accomplish this offset H, a throttle lever 31 is used that rotates on pivot screw 32. Bracket 28 is suitably bent that spaces the throttle lever between wires 25. This is more clearly shown in end view in FIG. 3. The bottom of the lever branches into two legs 31' that straddle flats 33 on the slider block. Pins 34 are presed into the block to engage slots in each leg. Back and forth rotation of the throttle link thereby results in bidirectional sliding motion of the block. This rotation is created by attaching a throttle control rod to a hole 35 in the throttle link at any designated height H. Use of a throttle link makes the space available directly behind the engine, so the engine can be located close to the firewall. Simple spacers may be used to mount the rear plate 12 using screws thru holes 30 an into the firewall to provide clearance for the throttle mechanism. Thus, the rear plate also serves as an engine mount.

Since a key advantage of this radial engine design is its absence of inertial vibration, a procedure for synchronizing the individual 2 cycle engines will now be described. Referring to FIG. 2 where the gears are shown in end view, we require that diametrally opposite engines be phased identically. In other words, both pistons are to reach top dead center (T.D.C.) at the same time, so their inertia forces can cancel. To accomplish this, the output gear 18 is preferably designed to have an integral multiple of 6 teeth (6 is the number of cylinders). This creates a tooth space 36 every 60 degrees, one at each engine location. The two engine shafts 7 and 7' are rotated so that their pistons are at T.D.C. Then their gears 9 and 9' are locked to the shafts with teeth 37 & 37' at their 6 o'clock positions. Gears 9 are locked in the proper angular position by threading the gear onto the shaft and locking it using a lock-nut and thread retaining compound. The two engines are put into place, meshing teeth 36 with 37 and 36' with 37'. The two engines are then loosly fastened into the right mounting plate 4 using screws 5.

The next pair of engines are to be phased 120 degrees from the first. So their shafts are rotated 120 degrees from T.D.C. and their output gears locked in place with a tooth in the same 6 o'clock position. This tooth will mesh with the existing space in the output gear. The last two opposed engines are phased 240 degrees from T.D.C. in the same manner. Since for 2 cycle engines, one power stroke occurs for each revolution of the engine shaft, by equally spacing the firing every 120° the output torque of the radial engine becomes smoothest. So in general, it is preferred to equally space paired cylinder firing; which for 3 pairs is 120 degrees. This minimizes net output torque ripple. Once all 6 engines are assembled to the front plate, the rear plate is installed. Ball bearings 8 already in the rear plate accurately locate the 6 engine shafts angularly and radially and they set the desired radial distance between gears. After installing the spacer posts 13, the engine mounting screws 5 are tightened. Installation of the throttle mechanism & muffler completes the engine assembly.

Having thus described the preferred embodiment of the instant invention, and where as the choice of a 6 cylinder engine was chosen for illustrative purposes only, a more generalized detailed discussion of why the radial engine is force balanced is in order. FIG. 4 is a general schematic of opposed engines (2 cycle or 4 cycle) showing their individual slider crank mechanisms. Pistons 38 and 38' both move toward top dead center of their respective cylinders at the instant depicted for counter clockwise rotation of the output gear 18. Consequently, their inertia forces cancel everywhere in the cycle.

With regard to counter balancing the connecting rod 39, it is a usual engineering approximation to distribute the weight of the connecting rod between the piston and crank pin 42. The portion going to each piston is the same, so the pistons counterbalancing one another is not affected. The equivalent mass of the crank pin has been increased but since it rotates about the engine shaft 7, a counterweight 41 can be used to completely balance it. In fact, the single cylinder 2 cycle engine is crank pin balanced using this same condition. So use of 2 cycle engines in the instant invention results in a completely force balanced radial engine.

Due to the fact that the pistons & crank mechanisms lie in the same plane and center of mass of the counterweights all lie in a plane in this invention, no inertia couple is formed. Thus, this radial engine configuration is inertia force as well as inertia couple balanced. Naturally, the output shaft torque varies as each pair of cylinders contributes a power stroke, but this effect is not an inertia imbalance.

It is not theoretically exact to divide up the connecting rod mass as it undergoes a complex motion. In reality, a very small unbalanced couple will exist in the engine plane due to the nutation of the connecting rod. This adds to or subtracts from the engine torque in the same plane and is of minor importance.

Reference is now made to FIG. 5 which shows timing belt 43 as an alternative to gearing to synchronize each engine and to couple them to the output shaft. A simgle belt connects all engine pulleys 44 in series with the output pulley 45 and allows counter clockwise shaft rotation of each engine. The output shaft direction is reversed as with gearing to rotate counter clockwise when viewed from the front of the radial engine. However, the tension in the belt increases as it passes over successive engines. This creates increasing radial loads on support bearings 8 and on the internal sleeve bearings of the engines. Sleeve bearings are not suited to support these loads and such a drive has been found to be considerably inefficient compared to gearing. Ball bearing supported engines can be employed but their cost is substantially greater. Mating the back side of the belt with the output pulley results in the desired counter clockwise rotation of the output shaft when viewed from the front.

The use of a belt drive also imposes large cyclic bending stresses in the engine shafts 7 and output shaft 3. When gearing is used, it imposes no net force on the output shaft because opposed engines fire at the same time and deliver their torque simultaneously. Opposed gear contact forces cancel and only a torque without bending is opposed on the output shaft. Use of a smaller lighter weight output shaft is possible, that is not prone to fatigue failure.

Another belt drive uses 6 individual radially oriented timing belts to connect the engines to the output shaft. This is not compact as the axial space required becomes excessive for positioning the belts next to one another. Furthermore, costly radial adjustments are required.

The following portion of this disclosure constitutes a continuation in part of patent application Ser. No. 07/276,943 entitled: "Balanced Radial Engine."

It was previously disclosed that the individual engines that comprise the instant invention each has its own carburetors with an air intake 50 and throttle lever 51 as shown in FIG. 1. FIG. 6 is a sectional view of a typical carburetor taken along view 1—1 of FIG. 1. It has been increased in size for clarity. It shows a fuel inlet fitting 52 and needle valve 53 that uses a threaded valve stem. The threaded stem axially moves the tapered point 54 to adjust the fuel flow to the carburetor's air stream. The point is moved into or out of the valve seat 55 to adjust the fuel flow cross sectional area. Rotation of lever 51, changes the cross sectional area of the air induction port 50' thereby controlling engine power.

The adjustment of multiple needle valves 53 to produce optimum engine performance is at best very difficult to perform. Certainly, without the aid of a tachometer it is nearly impossible. A single control valve is desired as exists in a single carburetor engine for quick and easy adjustment. The valve as well as the fuel system must insure optimum mixtures for each carburetor at all power settings, in multicarburetor engines.

A problem complicating equal fuel delivery in this radial engine is that the carburetors are at different elevations. In a gravity flow system, the carburetors at lower elevations experience a greater head of fuel pressure and would run richer than higher elevation carburetors. Use of a fuel pump is expensive and fuel tank pressurization using muffler back pressure is not sufficient at low speeds, so a practical gravity flow system is desirable.

The use of two gravity fed fuel delivery systems are disclosed to solve this problem. An upper fuel tank supplies the upper three carburetors and a lower fuel tank supplies the remaining lower three carburetors. The elevation difference between the upper three carburetors in FIG. 2 is relatively small. In a prototype 6 cylinder radial engine this head difference was only ¾ inch and had minimal effect on mixture variations between the three carburetors. As a result one head compensation fuel tank was sufficient for these three carburetors.

Figure 7:
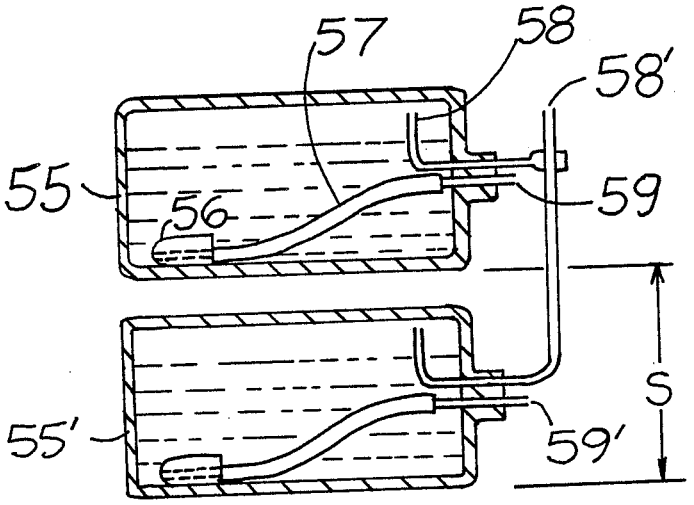
Figure 8:
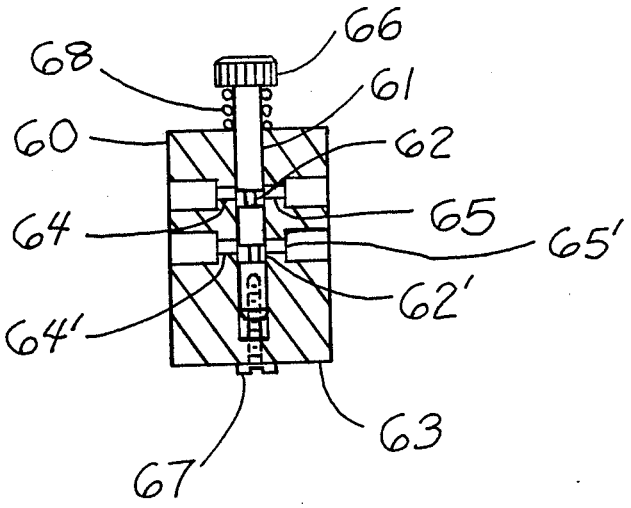

FIG. 7 shows the use of two rigid plastic tanks 55 & 55' at an elevation difference "S". This distance "S" should be about the same as the mean elevation difference between the upper 3 and lower 3 carburetors of the radial engine to compensate for their head heights. In this way, even if the fuel tanks are pressurized (with for example internal muffler pressure) then the fuel pressures in each fuel line will still only differ by head S.

Radio Control model fuel tanks 55 usually employ a hollow weight 56 and flexible tubing 57 that allows drawing fuel even when the aircraft is in inverted flight. An air vent 58 is used to allow gas to enter as fuel is removed. In the instant invention, the two vents connect to a common inlet fitting 58' where muffler pressure may be introduced to provide a desirable pressure increase that occurs at high throttle settings. When high engine power is used and high muffler pressure is available, the head compensation feature of the two tanks is not essential, as the muffler pressure is sufficiently high. However, at low power settings or at idle, low muffler pressure exists and the two tank system automatically becomes functional to maintain equal fuel pressures at the upper 3 and lower 3 carburetors. This in turn results in equal flow rates of fuel.

Fuel exits each fuel tank independently thru lines 59 and 59' to supply the upper and lower carburetors respectively. Equal flow rates are to be produced in each line in order to have equal mixtures in the upper 3 and lower 3 carburetors. This is accomplished using spool valve 60 with a single adjustable spool 61. The valve body 63 is shown in section and size is enlarged for clarity. The spool is cylindrical in shape with two grooves 62 and 62'. The spool fits closely in the round bore of valve housing 63. The valve has fuel inlet ports 64 for the upper tank line and 64' for the lower tank line. Fuel passes thru inlet port 64, through groove 62, and then out the outlet port 65. Due to the close fit between spool and housing, the two fuel flows do not appreciably mix. As the spool knob 66 is rotated clockwise, the spool moves axially along the stationary thread of screw 67 and simultaneously and equally closes the two ports. Making the pitch between ports and grooves the same to a high accuracy, insures equal flow cross sectional areas at both ports. This creates identical flow rates thru each line when the pressure difference is the same.

Identical pressure differences are guaranteed across each port by the head compensated two tank systems. It should be stated that the upper three carburetor inlet fittings 52 are manifolded together using for instance rubber tubing and connect as a unit to the valve outlet port 65. Similarly for the bottom three carburetors connecting to valve outlet port 65'.

By making the grooves in the spool sufficiently deep, they do not add significant flow resistance to the fuel circuit and their manufacture to a close depth tolerance is not required. The total spool valve resistance is the sum of the inlet & outlet port cross sectional area resistances. The diameter of ports 64 and 65 should be less than the spool diameter for good alignment and ease of manufacture, and should be sized for the maximum anticipated flowrate.

A spring 68 may be used to provide friction for maintaining an adjusted knob position. It is usual practice that the valve setting is optimized by listening to the engine sound level. It is adjusted to peak engine output power or R.P.M. The individual carburetor needle valves 53 are to be left primarily in their open position so as not to provide appreciable flow resistance. Needle valves 53 may even be removed and the opening plugged, eliminating their use.

In general, one could employ as many fuel tanks as the number of carburetors it was necessary to pressure compensate. The spool valve would then have multiple ports for each tank used. The previous example using two tanks and a two port valve is illustrative only and has been found to function well in a 6 cylinder radial engine.

Figure 9:
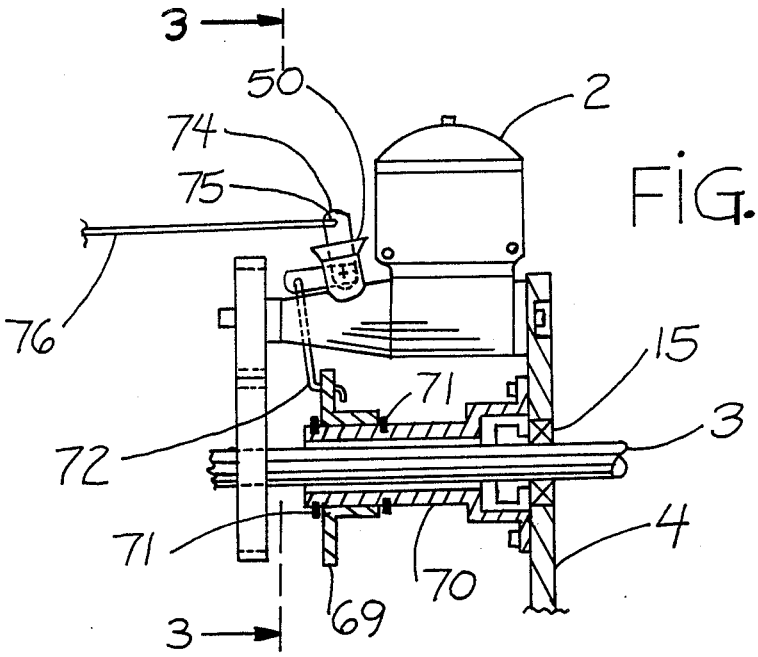

An important feature of model aircraft engines is that they be as compact as possible. An improved throttle control mechanism is now disclosed that shortens the length of the engine. The throttle lever 31 and slider 33 which are located at the rear of the engine in FIG. 1 can be eliminated. FIG. 9, which is a partially sectioned side view of the radial engine similar to FIG. 1, shows an alternative mechanism. This throttle mechanism consists of a round disc 69 that can rotate. A flanged aluminum tube 70 surrounds the output shaft and serves as a bearing and support for the disc. The flange of tube 70 is attached to the front plate 4 of the engine with screws. Snap rings 71 may be used to axially constrain disc 69. Use of delrin or other plastic for the disc provides low friction on the tube surface. The use of a round disc is illustrative only, and provides a low cost means for the attachment of carburetor wires.

Six equally spaced clearance holes in the disc, near its periphery, are for the insertion of Z bend terminated steel links or wires 72. One wire goes to each carburetor link 51. A Z bend at the other end of the wire, angularly located 90 degrees to the first, permits inserting link 51 onto the wire. Link 51 may then be screwed onto its respective carburetor using screws 73. Rigid wires 72, transmit rotary motion of the disc to rotation of links 51 as a three dimensional linkage mechanism. The motion of links 51 on each carburetor are perfectly synchronized and are of equal angular motion as the disc is rotated.

To operate the throttle mechanism, means can be provided to rotate the disc directly. However, accesses to the disc, as it is located inside the engine is not convenient. The prefered method is to actuate one of the carburetor links 51 directly. Movement of a single link 51 also causes the disc to rotate and all remaining links are forced into synchronism. This has worked on prototypes very smoothly in both directions of rotation. To provide an attachment point for actuation, one of the carburetor links 51 is provided with an attached arm 74 that has a hole 75. This actuator link may be positioned at any desired carburetor facilitating easy hook up to a push rod actuator 76. The top carburetor, is illustrative of this extra arm 74.

A small amount of clearance in the attachment holes for the Z bend wires 72 is desired in order to allow the wire to self align itself at both ends as links 51 rotate. The ends of the wire describe a complex 3 dimensional envelope as the disc rotates so if clearance is not provided, bending or binding of the wire could occur. A more expensive solution would be to employ small ball joints at each end of the wire.

Figure 10:
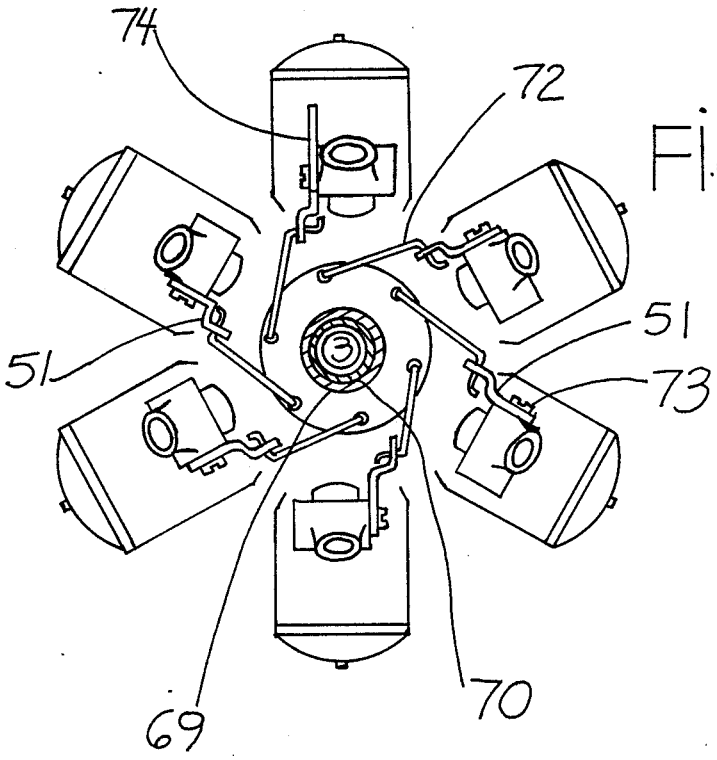

FIG. 10 is an end view of the engine along view 3—3 of FIG. 9 and shows the end of disc 69. The hub of the disc has been sectioned for clarity. The throttle wires 72 are clearly seen equally spaced & attached to carburetor links 51. The support tube 70 surrounds the output shaft 3 but has clearance with it. Although the support tube is preferably attached to front plate 4, any rigid means of support will suffice. For example, brackets attached to spacers 13 or other engine parts may be used.

In summary, the disclosed alternative embodement for a throttle control mechanism is totally enclosed within the confines of the engine end plates and adds no length to the engine. The use of Z bend wire connections to the central disc is highly reliable and requires no maintainence. Negligible wear occurs with this type of pivot (even under vibration) using a delrin disc. This method of providing perfect synchronization for a plurality of carburetor throttles, from a single accessible control point is clearly compact and functional.

What is claimed is:

1. A gravity flow fuel delivery sytem for multi-carburetor engines that provides a single fuel mixture adjustment for all carburetors and compensates for fuel head elevation differences between carburetors, incorporating a plurality of fuel tank means with relative elevation differences corresponding to the elevation differences of the respective carburetors to be pressure head compensated, said individual fuel tank means each having outlet conduits that introduce fuel to an individually isolated inlet port of a single hydraulic valve, said valve posessing a single adjustment means and at least one isolated outlet port means matched to a respective one of said inlet ports for each fuel tank means, said valve producing equal and adjustable flow resistances due to movement of said single adjustment means between all the respective inlet and outlet port means in the valve thereby producing equal flow rates from each tank means.

2. A gravity flow fuel delivery system according to claim 1, wherein said single adjustment means is a single spool with circumferential grooves cut into the spool at the same pitch spacing as that of the inlet and outlet ports that are located in the valve body, whereby axial displacement of the spool changes the flow cross sectional areas of the respective ports equally.

3. A gravity flow fuel delivery system according to claim 2 wherein said spool is cylindrical and has threads that produce longitudinal motion of the spool relative to the valve body by rotation of the spool.

4. The invention according to claim 1 used as a fuel delivery system for an internal combustion radial engine composed of an even number of identical and fully functional single cylinder slider crank 2-cycle or 4-cycle engines, each engine comprising a piston, linkage means, carburetor means, and shaft, said engines being positioned in pairs in a common plane, said pistons are in line and diametrally opposed, said engine shafts are parallel to one another and to a central output shaft, said output shaft projects toward the front of the radial engine and said engine shafts project toward the back of the radial engine opposite in direction to said output shaft, and having synchronizing means positioned on said engine shafts for coupling said engine shafts to the output shaft whereby diametrally opposite pistons radially move in phase synchronism thereby cancelling all piston and linkage means inertial forces.

5. The invention according to claim 1 used as a fuel delivery sytsem for an internal combustion radial engine composed of an even number of identical and fully functional single cylinder slider crank 2 cycle or 4 cycle engines, each engine comprising a piston, linkage means, carburetor means, and shaft, said engines being positioned in pairs in a common plane, said pistons are in line and diametrally opposed, said engine shafts are parallel to one another and to a central output shaft, said output shaft projects toward the front of the radial engine and said engine shafts project toward the back of the radial engine opposite in direction to said output shaft, and having gears attached on said engine shafts for coupling said engine shafts to the output shaft, throttle means to synchronize the throttle of each engine, and muffler means consisting of a generally donut shaped exhaust manifold surrounding said output shaft at the front of said radial engine with passage means for the exhaust gas of said engines to be injected into the manifold.

6. The invention according to claim 5, wherein said engines are fastened to a first plate and each shaft of said engines is supported by a bearing located in a second plate, said second plate being supported by a plurality of spacer means to said first plate to provide an open structure, and both plates incorporating a central bearing to support said output shaft.

7. The invention according to claim 5, wherein said throttle means comprises a rotating member with bearing support means wherein said rotating member surrounds the output shaft, said rotating member having pivotally attached links coupled to each engine carburetor throttle to transmit equal motion and to provide synchronization of carburetors.

8. The invention according to claim 6, wherein said throttle means comprises a rotating member with bearing support means wherein said rotating member surrounds the output shaft, said rotating member having pivotally attached links coupled to each engine carburetor throttle to transmit equal motion and to provide synchronization of carburetors.

9. The invention according to claim 4 wherein said synchronizing means is provided by a single timing belt that connects said engine shafts in series with said output shaft.

10. The invention according to claim 5, wherein said single adjustment means is a single spool with circumferential grooves cut into the spool at the same pitch spacing as that of the inlet and outlet ports that are located in the valve body, said spool having cylindrical threads that produce longitudinal movement of the spool relative to the valve body by rotation of the spool.

11. The invention according to claim 7 wherein the rotating member is a round disc.

12. The invention according to claim 11, wherein said links have at least one end formed in a z shape to mate with holes in said disc.

13. The gravity flow fuel delivery system according to claim 1 wherein said fuel tank means are equally pressurized above atmospheric pressure using a pressure means.

14. The radial engine according to claim 5 wherein said individual fuel tank means are each pressurized using pressure from the muffler means.

15. The gravity flow fuel delivery system according to claim 13 wherein said single adjustment means is a single spool with circumferential grooves cut into the spool at the same pitch spacing as that of the inlet and outlet ports that are located in the valve body, said spool having cylindrical threads that produce longitudinal movement of the spool relative to the valve body by rotation of the spool.

16. A fuel control valve for multicarburetor engines that provides a single adjustment for apportioning equal rates of flow to all carburetors from a pressurized tank means, said tank means having an outlet conduit that introduces fuel to at least one isolated inlet port formed in said control valve, wherein said valve has a single spool with at least one circumferential groove, equal in number to that of said isolated inlet ports, cut into the spool at the same spacing as that of said at least one isolated inlet port, outlet ports formed in the valve body, each said outlet port serving a respective one of said carburetors, said at least one inlet port lying in a common plane with at least one of said outlet ports and communicating with such through said respective circumferential groove, said spool having cylindrical threads that produce longitudinal movement of the spool relative to the valve body by rotation of the spool, thereby creating variable and equal cross sectional flow areas between said inlet and outlet ports.

* * * * *